US008600904B1

(12) United States Patent
Schneider et al.

(10) Patent No.: US 8,600,904 B1
(45) Date of Patent: Dec. 3, 2013

(54) DOCUMENT DELIVERY SYSTEM WITH PROOF OF SERVICE

(75) Inventors: Stephen Schneider, Covina, CA (US); David DePaolo, Camarillo, CA (US); Christopher Floyd, Jackson, CA (US)

(73) Assignee: DWC Direct LLC, Camarillo, CA (US)

( * ) Notice: Subject to any disclaimer, the term of this patent is extended or adjusted under 35 U.S.C. 154(b) by 0 days.

(21) Appl. No.: 13/561,609

(22) Filed: Jul. 30, 2012

(51) Int. Cl.
*G06Q 30/00* (2012.01)

(52) U.S. Cl.
USPC ..... 705/330

(58) Field of Classification Search
USPC ..... 705/333, 330
See application file for complete search history.

(56) References Cited

U.S. PATENT DOCUMENTS

2002/0065831 A1* 5/2002 DePaolo ..... 707/104.1
2002/0091782 A1* 7/2002 Benninghoff, III ..... 709/206
2002/0104026 A1* 8/2002 Barra et al. ..... 713/202
2005/0132057 A1* 6/2005 Bresnan et al. ..... 709/227
2005/0246550 A1* 11/2005 Orbke et al. ..... 713/182
2006/0282379 A1* 12/2006 Wordekemper et al. ..... 705/40
2010/0082981 A1* 4/2010 Church et al. ..... 713/168

* cited by examiner

*Primary Examiner* — Allen J Jung
(74) *Attorney, Agent, or Firm* — Daphne L. Burton; Burton IP Law Group

(57) ABSTRACT

A document delivery system for electronic and physical documents with proof of service. The system may receive uploaded electronic documents for delivery to one or more electronic and/or physical endpoints. After the electronic documents have been received, the delivery system determines whether the received electronic documents should be delivered electronically or physically, based on recipient data in the delivery system. If physical documents are to be delivered, the system may intelligently decide whether to aggregate some documents into a multi-document package. The system provides for delivery by commercial carrier, postal service, and/or electronic delivery. Optional services available to the sender include, but are not limited to, certified mail, proof of service, and email confirmation.

22 Claims, 10 Drawing Sheets

PROOF OF SERVICE
06/07/2012

CONTACT PERSON: STEVE SMITH
CASE INFORMATION: EAMS 1000/JANE SMITH

| EAMS UDQ USE ONLY | DWCD SESSION ID: 20120606110102 000353842<br>The party filing this form automatically generated these documents using the DWC Direct online EAMS sevice. DWC Direct, LLC is a DWC-approved Third Party EAMS Filer. Learn more at DWCDIRECT.COM |
|---|---|

NOTICE: PAGES PRINTED DUPLEX. SCAN BOTH SIDES OF EACH PAGE TO ENSURE COMPLETE DOCUMENT INTAKE

Total no. of printed pages: 7

1010

Description of documents served:
Notice and Request for Allowance of Lien; Itemized Statement of Services;10770.5 Verification.

I, John Doe , Declare: I am not a party to this action and am familiar with the business, mailing and electronic delivery practices of DWC Direct, LLC. On 06/07/2012, I served the attached documents on parties listed on the attached Case Party Service List, either by placing a true copy thereof in a sealed envelope with postage fully prepaid in the United States Postal Service, or electronically in a manner approved by the recipient pursuant to Code of Civil Procedure section 1010.6 and Tiltle 8, CA Regs 10505 (Denoted by Electronic delivery in the Service List below) in the ordinary course of business (and there was no report of error or delay in the electronic transmission of the documents). I declare under penalty of perjury pursuant to the laws of the State of California that the foregoing is true and correct andthat my email address is jdoe@email.com 1015 John Doe Executed 06/07/2012 at Covina, California.

CASE PARTY SERVICE LIST 1020

INSURANCE COMPANY ONE
PO BOX 1234 ANYTOWN, CA 90000

INSURANCE COMPANY TWO
PO BOX 5678 ANYTOWN, CA 90000

FIG. 9

DWC Direct JetDeliver Receipt

910 PACKAGE ID Number
20120327-00034567890123456789

920 DELIVERY COMPLETE

SHIPPER: Chris Floyd

930 PACKAGE TITLE: SAMPLE DOCUMENT

File 1: Sample Document.PDF
1 Page, 32KB

940 DELIVERY CHARGE: $0.25

Original Estimated Charges:
1 Page, 1 recipient, US Mail: $1.25 /ea $1.25
Final Charges:
US Mail paper service: 0 recipients $0.00
JetView electronic service: 1 recipients $0.25

950 RECIPIENTS:

(001) Floyd, Chris / DWC Direct [ABC12345]
321 N. First St. Anytown CA 12345

960 DELIVERY LOG:

| | | |
|---|---|---|
| Thursday 2012-03-29 11:52:13 | ACCEPTED | Package accepted from JetShip. |
| Thursday 2012-03-29 11:55:20 | E-DELIVERY | Floyd, Chris [ABC12345] |
| Thursday 2012-03-29 11:55:20 | NOTIFICATION | [ABC12345] |
| Thursday 2012-03-29 11:55:21 | COMPLETE | Delivery complete. |

FIG. 10

DOCUMENT DELIVERY SYSTEM WITH PROOF OF SERVICE

BACKGROUND OF THE INVENTION

1. Field of Invention

The present disclosure relates to document delivery systems and, more particularly, to a delivery system for electronic or paper documents with proof of service of same.

2. Description of Related Art

Delivery of physical documents has been an important part of daily life for quite some time. At one point, the United States Postal Service and commercial carriers, e.g., Federal Express®, and/or personal couriers, were the main avenues for the delivery of physical documents. With, the rise of computers, electronic documents are being delivered with increasing frequency.

Under certain circumstances, it may be crucial or significant for the sender to verify that the documents have been sent to the intended recipient. In fact, in some cases, e.g., where legal and financial documents are involved, it may be required that the sender establish service to a recipient of the contents of transmitted documents. Businesses may exchange millions of electronic documents for which proof of service may be useful or required.

Accordingly, there is a need for a hybrid document delivery system that provides for proof of service of both physical and electronic documents.

In the field of document delivery, it may be inefficient to deliver different physical packages to the same physical delivery address. Accordingly, there is a need for aggregating documents addressed to the same delivery address into a single physical package.

BRIEF SUMMARY OF DISCLOSURE

The present disclosure addresses the needs noted above by providing a delivery system for electronic and paper documents with proof of service. In accordance with one embodiment of the present disclosure, a document delivery system is provided with proof of service for physical and electronic documents. The system comprises a document receipt subsystem configured to receive electronic documents for delivery to one or more physical and/or electronic endpoints, the document receipt subsystem being further configured to receive a request for proof of service of each received electronic document to the one or more physical and/or electronic endpoints; and a mail delivery subsystem configured to determine whether a received electronic document is to be delivered to a recipient via physical or electronic endpoint based on recipient data. The mail delivery subsystem is further configured to deliver the received electronic document to electronic endpoints, if the determined endpoint is electronic.

The system also comprises a formatting subsystem configured to format the one or more endpoints according to a formatting standard so that each physical endpoint is matched to a known endpoint, if the determined endpoint is physical; and an aggregation subsystem configured to facilitate the aggregation of physical documents into a single multi-document package for delivery to the one or more endpoints, if the determined endpoint is physical.

The system further comprises a proof of service subsystem configured to provide proof of service of each served physical and/or electronic document if a proof of service request has been received; and a receipt record subsystem configured to generate and deliver a receipt record to a shipper, wherein the receipt record includes delivery data for the delivered document, including the time the electronic document was delivered to the electronic endpoint and/or the time the physical document was released to a carrier for physical delivery.

In accordance with another embodiment of the present disclosure, a computer-based method is provided for proof of service of physical and electronic documents. The method comprises the steps of receiving electronic documents for delivery to one or more physical and/or electronic endpoints; storing the received electronic documents; and generating a unique identification code for each electronic document received for delivery to the one or more physical and/or electronic endpoints.

The method further comprises the steps of determining whether a received electronic document is to be delivered electronically or physically to a recipient based on recipient data. If the determined delivery method is physical, the method comprises formatting one or more physical endpoints according to a formatting standard so that each physical endpoint is matched to a known endpoint; and aggregating the physical documents into a single multi-document package for delivery to the one or more physical endpoints, or based on unbundled delivery requirements associated with a particular endpoint of the one or more endpoints, determining that aggregation will not occur for physical documents to the particular endpoint. If the determined delivery method is electronic, the method comprises delivering the received electronic documents to electronic endpoints; and providing proof of service of each physical and electronic document. The method also comprises generating and delivering a receipt record to a shipper, wherein the receipt record includes delivery data for the delivered document, including the time the electronic document was delivered to the electronic endpoint and/or the time the physical document was released to a carrier for physical delivery.

These, as well as other objects, features and benefits will now become clear from a review of the following detailed description of illustrative embodiments and the accompanying drawings.

BRIEF DESCRIPTION OF DRAWINGS

FIG. 9 is a proof of service generated by the system in accordance with one embodiment of the disclosure.

FIG. 10 is a screenshot of a sender's receipt record for the package subject to proof of service in accordance with one embodiment of the present disclosure.

DETAILED DESCRIPTION OF THE DISCLOSURE

Figure 1:
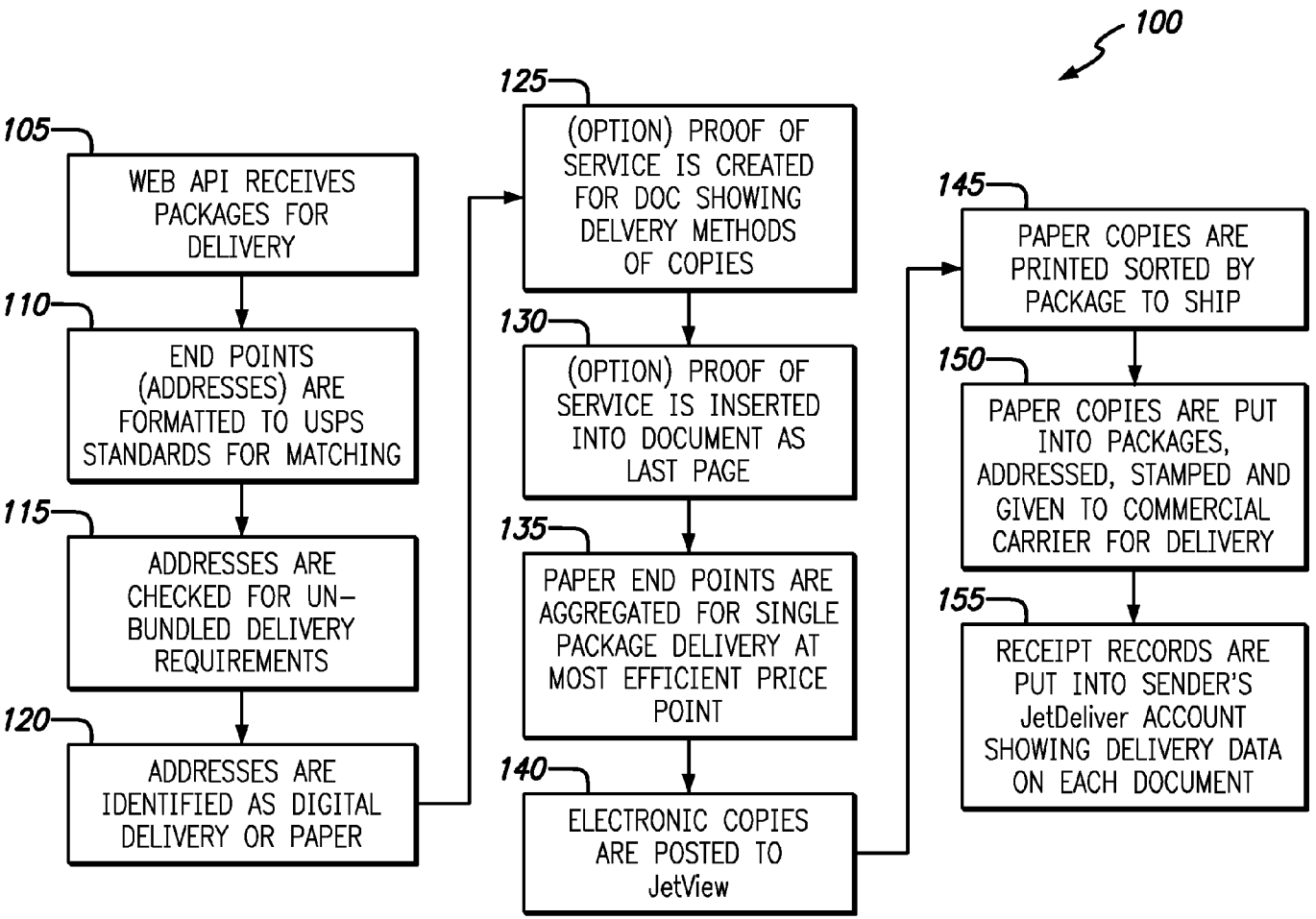
FIG. 1 is a flow chart for the document delivery system with proof of service in accordance with one embodiment of the present disclosure.

The document delivery system of the present disclosure may receive uploaded electronic documents, so that the documents may be delivered in either physical or electronic form to one or more recipients or endpoints. The endpoints may be physical or electronic. A physical endpoint may be a street address, post office box or other physical location. An electronic endpoint may be an inbox associated with the intended recipient, and the inbox may be provided by the document delivery system. The upload may be accomplished by a sender/shipper, who may request that the documents be delivered to specified recipients or an alias associated with an endpoint. The alias may be, for example, a company name.

The document delivery system of the present disclosure may provide proof of service of both physical and electronic documents. These documents may include writings, photographs, images, graphs and charts. The documents may also include sound recordings, and other data or data compilations, e.g., computer programs or any other information. It should be noted that certain documents may originate in physical form and may be scanned and received or uploaded as electronic documents by the document delivery system.

After the electronic documents have been received by the document delivery system, the system's mail delivery subsystem may determine whether the received electronic documents should be delivered electronically or physically, depending on the delivery method chosen by the intended recipient. At used herein, documents uploaded and received by the document delivery system—but not yet served or delivered as physical and/or electronic documents—are referred to as received electronic documents. Where the intended recipient has chosen digital delivery to an electronic endpoint, the document may be delivered electronically to the system. The document may then be opened thereafter by the intended recipient when the intended recipient logs onto his/her account. Where no delivery method has been designated, physical delivery to a physical endpoint may be the default option.

A proof of service may be generated once the delivery method has been determined. The proof of service may document how the method of delivery is to be made. As used herein, the terms "served electronic document" and "served physical document" refer to received electronic documents that have been served, but not necessarily delivered yet. However, a received electronic document that is to be served to an electronic endpoint may be considered served and delivered when it is delivered to the recipient's inbox. A received electronic document that is to be served to a physical endpoint may be considered served when it is placed into a physical mail stream and/or transferred or released to a physical carrier for delivery.

The proof of service may be digitally or electronically signed by a person associated with the system who certifies the manner in which proof of service is carried out. This part of the proof of service process is the same regardless of whether the documents are delivered electronically or physically. If the documents are to be electronically delivered, a copy of each document may be electronically delivered to the intended recipient via an inbox associated with the system or other electronic means. The proof of service may be attached to the document, if the document is electronically delivered.

If the documents are to be physically delivered, a document constituting the proof of service may become a part of the physical document package to be delivered. In this case, the documents may be physically released or transferred to a commercial carrier e.g., the United States Postal Service or FEDEX®, so that it may ultimately be delivered to the intended recipient at a physical endpoint. In this case, the document delivery system may rely on the third party carrier to effect delivery of the physical document. The proof of service may be inserted into the document as the last page.

Where the received electronic documents are to be delivered as physical documents, the document delivery system of the present disclosure may aggregate the documents into a single package at an efficient price point. The document delivery system may intelligently decide whether to aggregate the document along with other documents into a multi-document package and provide for delivery either by commercial carrier or other physical delivery method. As used herein, the term "delivered physical document" refers to a physical document that has been physically delivered to the physical endpoint for an intended recipient. The term "delivered electronic document" refers to an electronic document that has been electronically delivered to an electronic endpoint.

Optional services available to the sender may include, but are not limited to, certified mail, proof of service, and email confirmation. As for the certified mail option, the sender would choose this option if the sender wanted a certified receipt confirming physical delivery, not just a confirmation of mailing. Senders who select this option may receive a scanned image of a declaration of actual physical delivery and signature by the end point recipient. In the case of physical delivery, this image could be in the form of a signed United States Postal Service certified mail card, or an image of a declaration of personal physical service on the endpoint recipient by a person (such as from a courier service). In the case of electronic delivery, this image could also take the form of a signed declaration of an employee associated with the document delivery system. This declaration may confirm that the piece was delivered electronically within the network and was actually opened by the endpoint recipient.

As for the email confirmation option, the sender would choose this option if the sender wanted an email confirmation of the mailing of a document—not a confirmation that it was received or read. The system would send the sender an email when the document was mailed or delivered electronically. This email would not be a signed or confirmed receipt that the endpoint recipient read the document.

After the package has been delivered, the sender may receive a receipt that includes an audit log. Where the documents have been delivered electronically via the document delivery system, the audit log may show when the document was received at the recipient's electronic endpoint or, for delivery to physical endpoinith, when the document was released or transferred to a carrier.

After document delivery to electronic endpoints, the system may thereafter track electronic actions taken in connection with the document/package. For example, the system may track when the document was opened, and/or when the document was printed and/or forwarded. A bar code associated with the document may facilitate its tracking. The audit log may also show when the intended recipient logged on to the system since the system is a web-based application programming interface (API). If a document was opened, the system may track how long it was opened. The system knows if the intended recipient saw the title for the transmitted document in their inbox. As long as the document is in the data server for the document delivery system, it can be tracked. The system may also include encryption or other data protection measures in order to prevent unauthorized access.

In some circumstances, a document may be delivered electronically by the document delivery system, but may remain unopened for a long period of time. In this case, the sender/shipper may elect to have the system recall the unopened document from the electronic delivery endpoint and change the delivery method to paper. Then, the system would re-send the previously delivered document as a paper document. The document delivery system of the present disclosure may be useful for a number of persons and entities, and may also be useful for businesses that regularly send documents back and forth to each other. Each document designated for delivery may have a unique identification number. Using that unique identification number, the document may be tracked from the time it is received by the system until it is delivered to an endpoint or recipient.

This document delivery system may be implemented as a web-based system. The system may be accessible via the Internet by subscribers who provide the proper authentication credentials.

Referring now to FIG. 1, illustrated is a flow chart for the document delivery system in accordance with one embodiment of the present disclosure. Flow chart 100 includes steps that may be taken by the document delivery system from the time the packages are received up until the time the packages are delivered.

At step 105, the web application programming interface (API) may receive packages to be delivered by the document delivery system. At step 110, the end points or recipients' addresses may be formatted according to certain standards. For example, the addresses may be formatted so that whenever the word "Boulevard" or "Boulv" or a variant thereof is typed, it appears as "Blvd." or is corrected to appear as such. This way, there is consistency among the addresses and a match can be readily ascertained. Otherwise, the system may not understand that 103 Washington Boulevard and 103 Washington Blvd. are the same address. An example of a body of addressing standards are those implemented by the United States Postal Service, which can be found at Publication 28, Postal Addressing Standards 7610-03-000-3688, published in April 2010.

Along those same lines, if the user misspells a word in the address, the misspelling of the word can be recognized. For example, the system may be configured to correct "Bulevard", an obvious misspelling that is substantially similar to the actual correct spelling, so that it reads "Blvd." The document delivery system may also be able to determine where a street has been misaddressed as an avenue, a route has been misaddressed as a lane, etc.

At step 115, addresses may be checked for unbundled delivery requirements. Here, the package may be flagged where multiple persons/entities occupy the same address. If there are multiple occupants at the same address, then the system may determine that the packages cannot be aggregated as described in more detail in connection with step 135.

At step 120, the addresses may be identified as either a digital delivery address or a paper/physical delivery address. This identification may occur based on the manner in which people at the address have agreed to accept documents—via electronic or physical delivery. Subscribers to the document delivery system may elect to have all documents delivered electronically. For non-subscribers, the default may be set to physical delivery of all documents.

At step 125, optionally, a proof of service may be created for the document showing delivery methods of copies. If the proof of service option is chosen, then at step 130, the proof of service may be inserted as the last page of a document if a physical delivery method is chosen.

At step 135, paper end points may be aggregated. That is, multiple documents addressed to a single address may be aggregated into a single multi-document package. This way, delivery may be accomplished at the most efficient price point. In addition to price point, the scheduled delivery time may also be a determining factor in how the documents are aggregated. Based on the scheduled delivery time, common addresses may be pooled into one package. Collation of the mail to a single endpoint may occur prior to delivery of the documents to a print stream. Where the address is a shared suite with different entities sharing a common address, the system may decide to de-aggregate documents based on the address, and then to re-aggregate them based on name. In this case, documents addressed to a particular recipient may be contained in a single multi-document package. Hard copies of documents coming from the print stream may be delivered physically via common carrier or other suitable carrier.

The system may convert addresses into a standard format, e.g., a standard post office format. The system also may take into account the fact that different users may type in the same address in different ways. The system may convert an address into standard post office address format. For example, no matter how a user spells a street name, the system may recognize the misspelling and suggest a known post office standard address—even if the named recipient is different. The system may also look at the unique address, as standardized by the system, and determine whether the user has an account with an electronic mailbox to which all documents may be delivered. Again, as indicated above, if an address—e.g., a suite—is identified, the system may determine that aggregation or consolidation of the package should not occur with any other address.

The documents in the package may include a cover sheet and, for electronic delivery, the cover sheet may identify the particular person to whom the documents should be delivered. If the documents are delivered physically via common carrier, the documents may have identifying information that is customary for the third-party carrier. The documents and/or package may not necessarily include a cover sheet.

At step 140, electronic copies may be posted to the document delivery system so that they may be retrieved by the intended recipient, if the subscriber/recipient has agreed to accept electronic delivery. The document may be posted in any type of format suitable for the system, including but not limited to a portable document format (PDF), rich text format, word processing format e.g., MICROSOFT® WORD®, or any other suitable format.

At step 145, paper copies may be printed and sorted by package for shipping. Sorting may occur before the physically-deliverable documents go to print. Sorting may occur manually so that the documents are stuck into package with paper identifiers. At step 150, paper copies may be placed into packages, stamped and given to a commercial carrier for delivery. At step 155, receipt records may be placed into the sender's account showing delivery data for each document. In the case of physical delivery, the shipper's receipt records may be created once the document has been released or transferred to the physical carrier. The document may be considered released or transferred to the physical carrier when, for example, it is placed into a mailbox for pickup by the United States Postal Service. The document may be considered released or transferred to the physical carrier when, for example, the documents are left in a deposit box under control of the carrier for pick-up by the carrier. In the case of electronic delivery, e.g., if the recipient has agreed to accept electronic delivery, the receipt records may be delivered into the electronic mailbox for the recipient's account.

Figure 2:
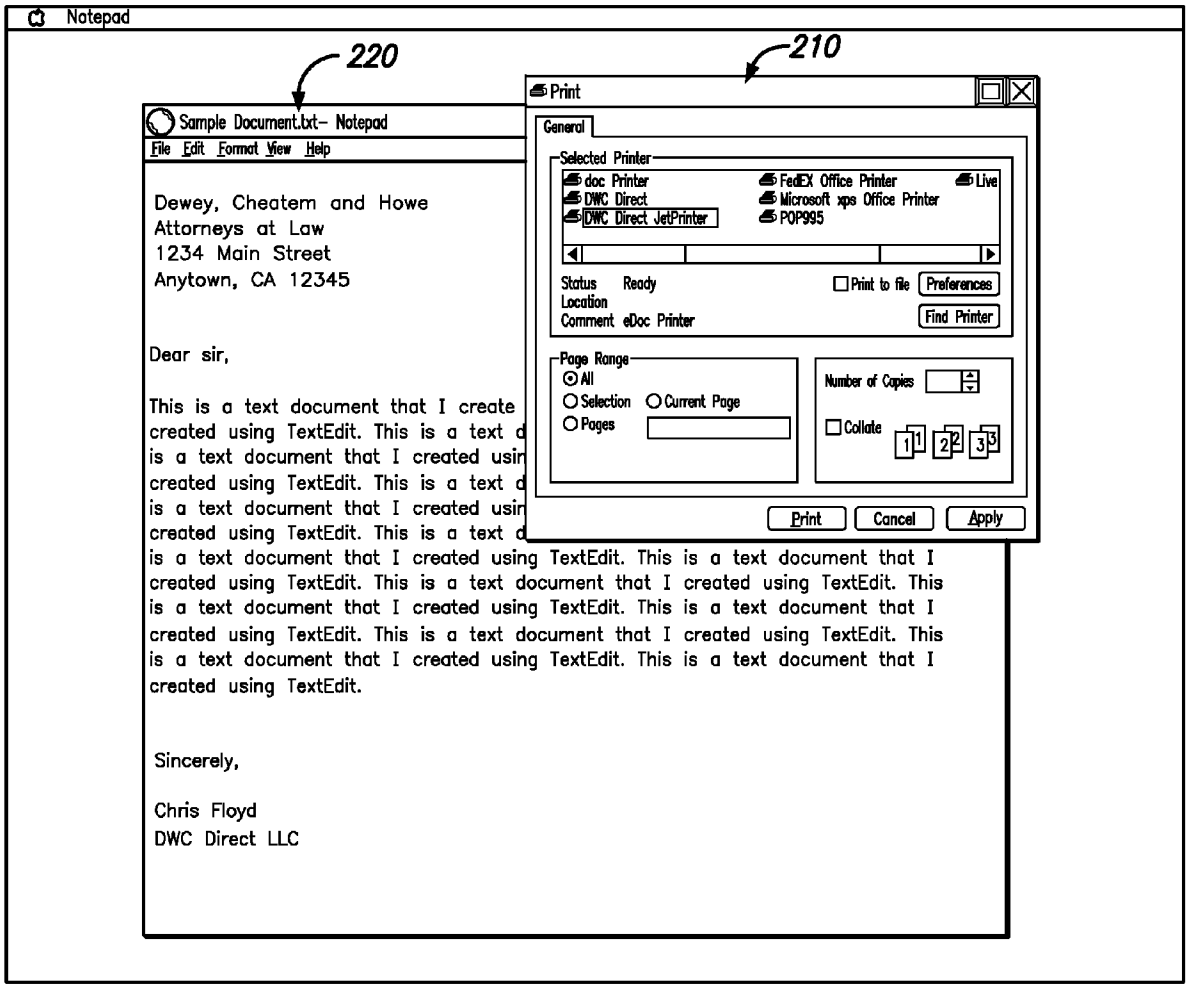
FIG. 2 is a screenshot illustration of the initial screen shown when a sender submits a document into the document delivery system in accordance with one embodiment of the present disclosure.

Described herein are also various computer screenshots that may appear when a user uses the document delivery system to carry out physical and electronic delivery of packages. Referring now to FIG. 2, illustrated is the initial screen shown when a user submits a document into the document delivery system in accordance with one embodiment of the present disclosure. As shown, the screenshot includes an electronic document 220 that the sender wishes to have delivered. The user submits the document into the document delivery system when the user selects the "print" function and designates the specific printer for the document delivery system. Here, the print dialog box 210 shows that the user is making the selection for the document delivery system which is designated here as "DWC Direct JetPrinter."

Figure 3:
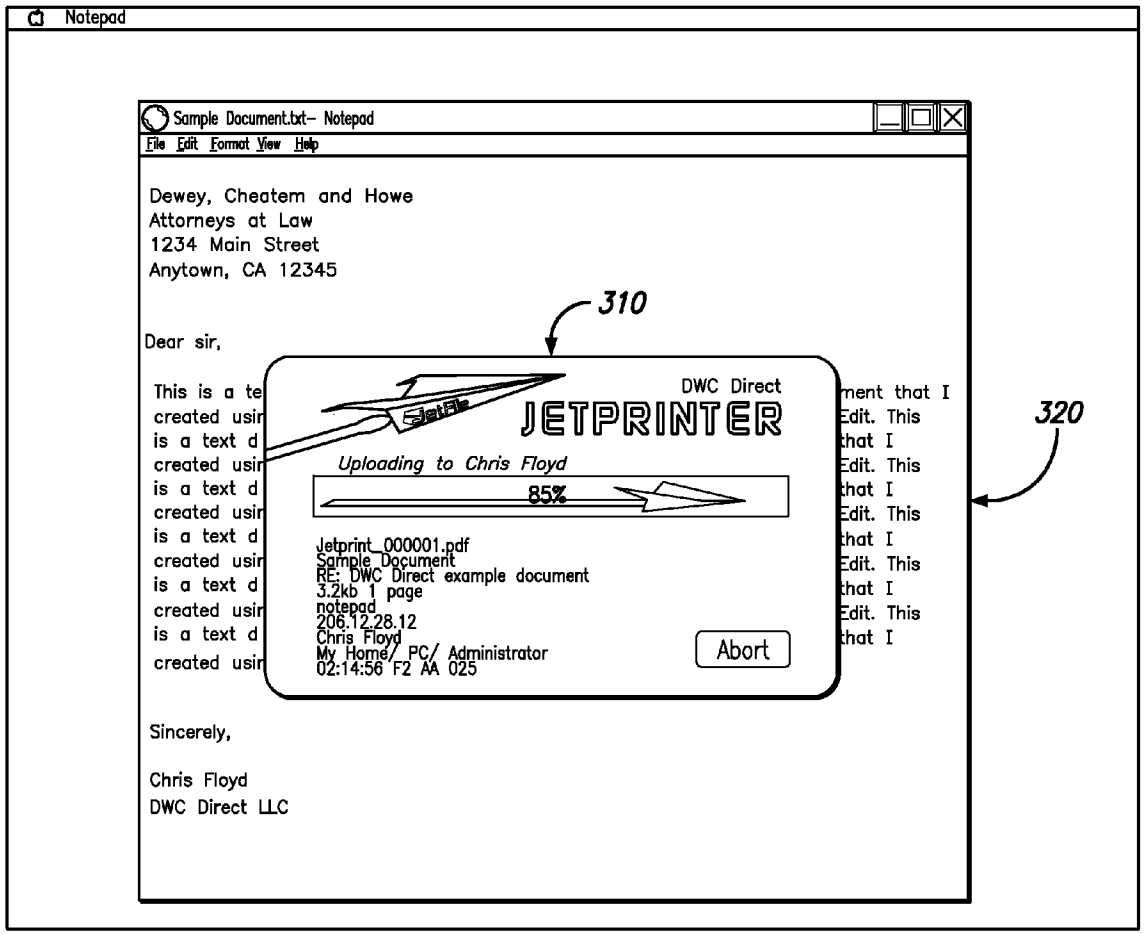
FIG. 3 is a screenshot illustration showing an upload of a document into the document delivery system in accordance with one embodiment of the present disclosure.

The user may now make sure the document or package (as represented by the electronic file) is uploaded into the system. Referring now to FIG. 3, illustrated is a screenshot showing an upload of a document into the document delivery system in accordance with one embodiment of the present disclosure. The electronic document 320 is shown with an upload dialog box 310. The upload dialog box indicates the progress of the upload. Here, the upload is eighty-five percent (85%) complete. This figure represents the percentage of the document's file size (in relation to its entire file size) that has uploaded into the system.

Figure 4:
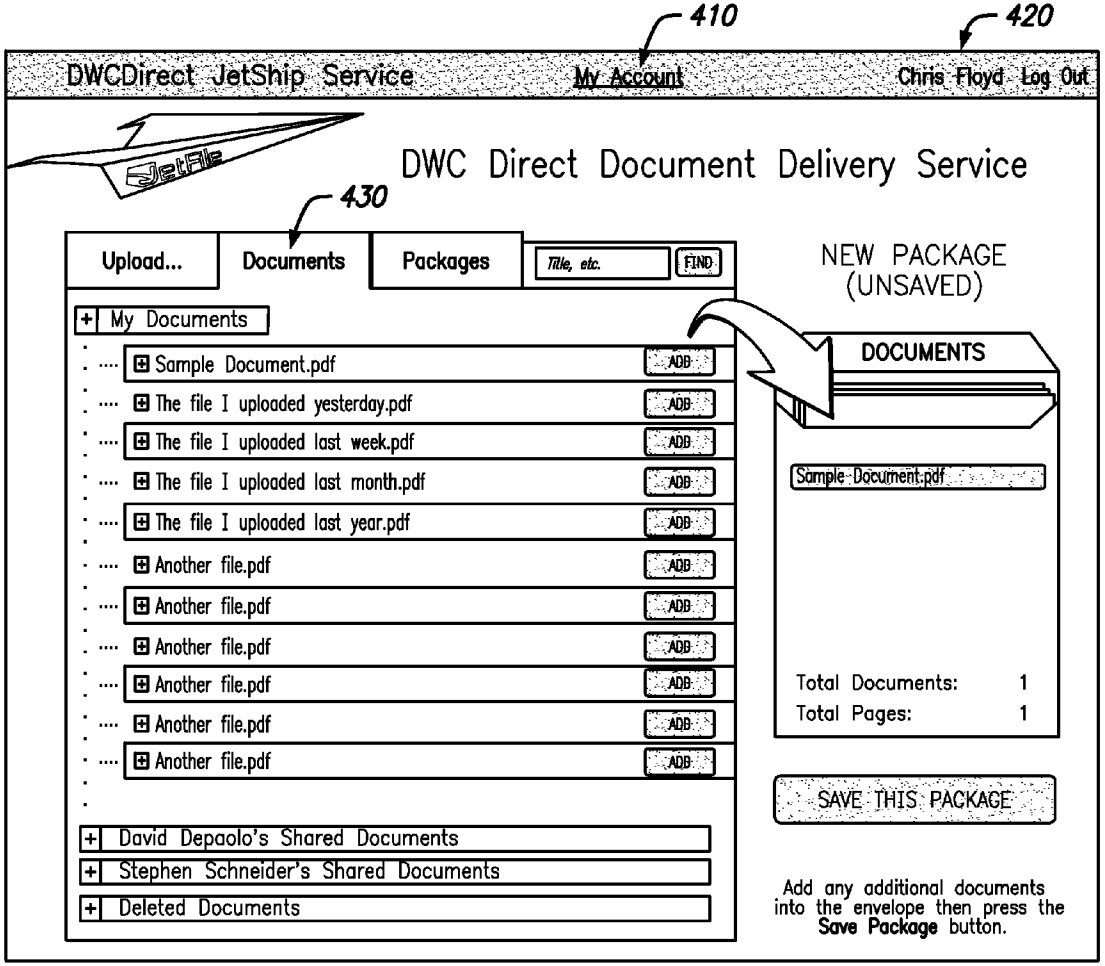
FIG. 4 is a screenshot that permits a user to enter additional documents into a package for the document delivery system in accordance with one embodiment of the present disclosure.

The user may manage and view uploads, documents and packages associated with the user's account by accessing the "My Account" section of the site. As part of this functionality, the user may enter documents into a package. Referring now to FIG. 4, illustrated is a screenshot that permits a user to enter documents into a package for the document delivery system in accordance with one embodiment of the present disclosure. At the uppermost part of the screen, the screenshot shows that the "My Account" section 410 of the site has been accessed by the user. The user's name can be seen at the user name section 420 of the screen. Here, the user is preparing to designate the document that was previously uploaded for delivery into a package. The user may add as many uploaded documents as the user would like into this package.

Figure 5:
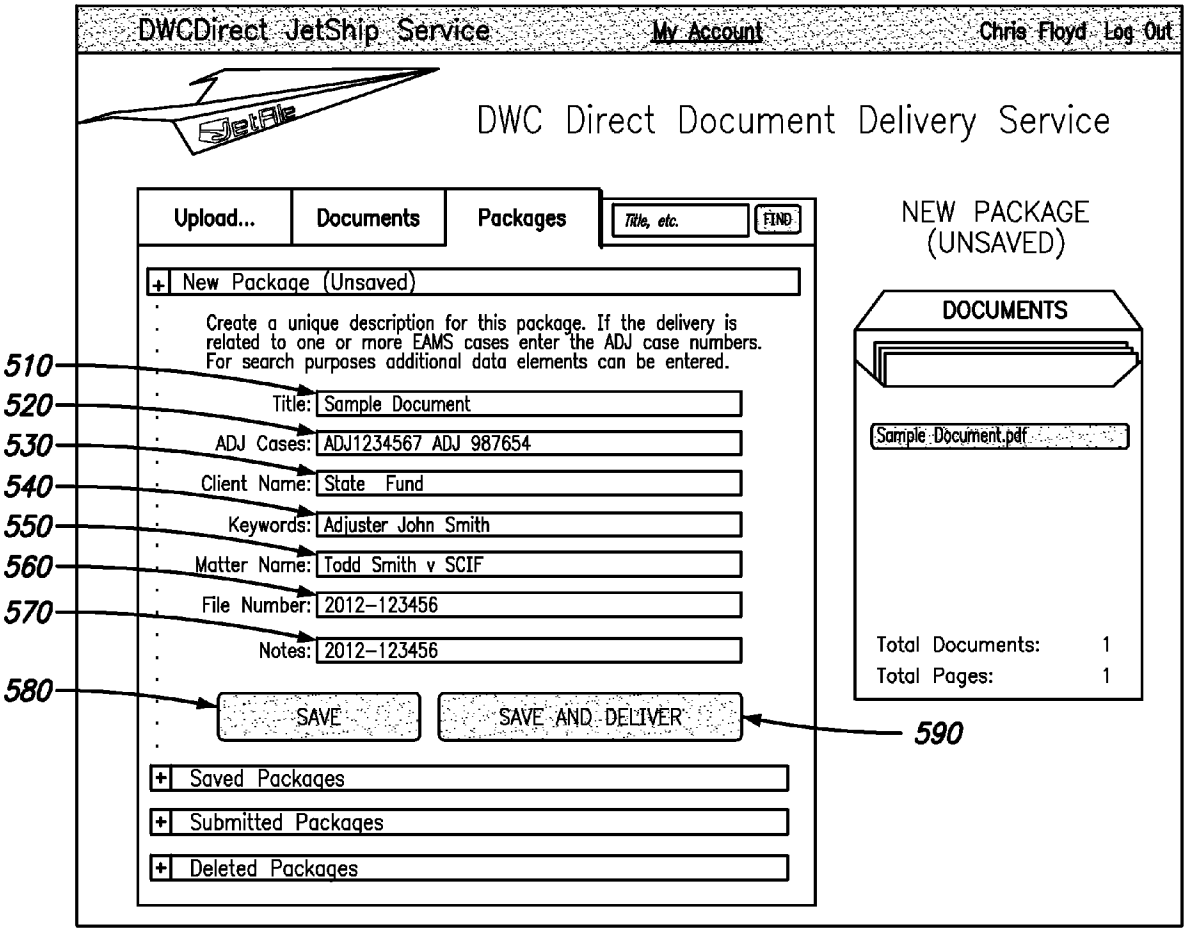
FIG. 5 is a screenshot that permits a user to enter information for the package to be delivered in accordance with one embodiment of the present disclosure.

Referring now to FIG. 5, illustrated is a screenshot that permits a user to enter a unique description for a new package that is to be delivered with proof of service in accordance with one embodiment of the present disclosure. As shown, the user may enter a title for the package. Here, the title "Sample Package" has been entered at text box 510. The user may also enter a case number for the package as shown at text box 520 below the title field. A client name and keywords may also be associated with the package. Here, the client name is State Fund and the keywords are "Adjuster John Smith" as shown at text boxes 530 and 540. A matter name, file number and notes may be associated with the package. Here, the matter name is Todd Smith v. SCIF as shown at text box 550. The file number is 2012-123456 as shown at text box 560, and the notes are 2012-123456 as shown at text box 570. Then the package may be saved using the "save" button at 580. Alternatively, the package may be saved and delivered by selecting the appropriate button 590. From the "Packages" tab, the user may also view saved packages, submitted packages and deleted packages as shown by the expandable buttons located near the bottom of the screenshot.

It should be noted that the terms entered to describe the package are searchable. Thus, if a user wished to search for all files having Adjuster John Smith associated with them, the user would enter "Adjuster John Smith" in the field at the upper right portion of the screen.

Figure 6:
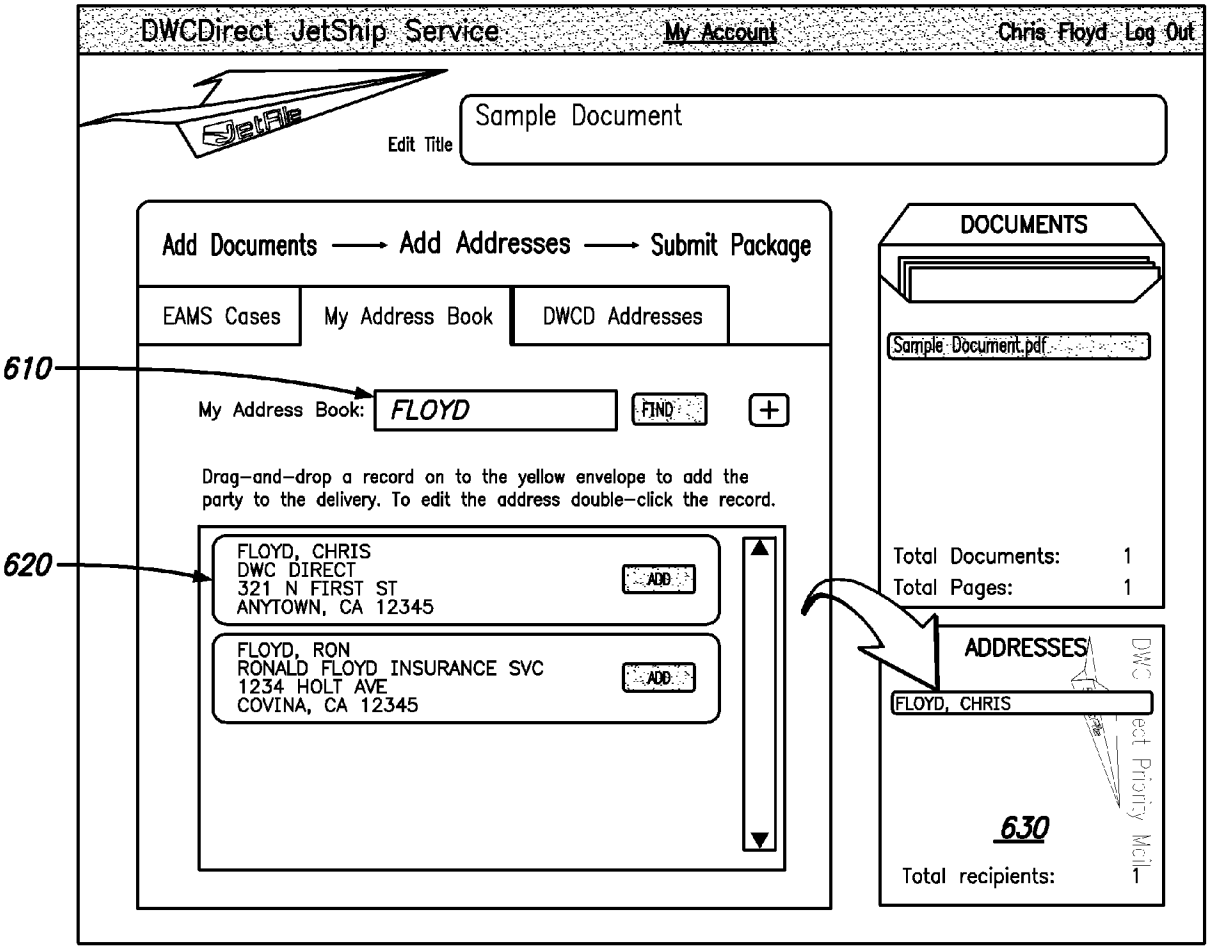
FIG. 6 is a screenshot that permits a user to enter a recipient for the package and submit the package for delivery in accordance with one embodiment of the present disclosure.

Referring now to FIG. 6, illustrated is a screenshot that permits a user to enter a recipient for the package and submit the package for delivery in accordance with one embodiment of the present disclosure. As shown near the top of the screen, the user may first add documents (performed in previous screenshot), then the user may add addresses. Finally, the sender submits the package. Here, the user is at the add address phase. The user selects the address(es) to which he/she would like the package delivered. Here, the addresses are separated by the user into three categories: (a) EAMS cases; (b) my address book; and (c) DWCD addresses. These categories represent the source for the address. The "My Address Book" source may represent a personal address book for the particular user. Here, the user has located the intended recipient by entering the search term Floyd in text box 610. The user then drags and drops the information for Chris Floyd from text box 620 into the envelope 630 at the right side of the screen.

Figure 7:
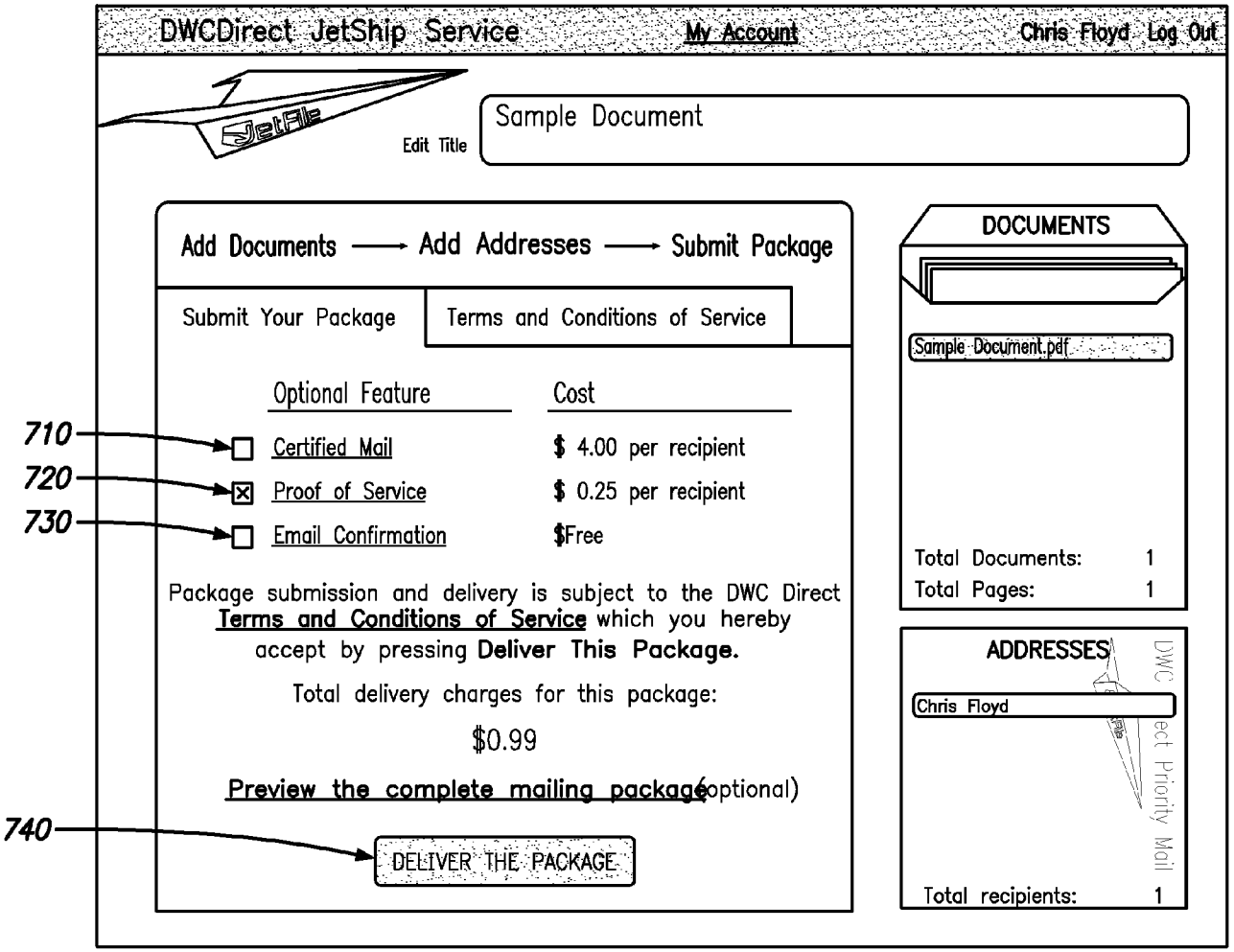
FIG. 7 is a screenshot that permits a user to select optional services for a package to be delivered by the document delivery system in accordance with one embodiment of the present disclosure.

Now, the user is preparing to submit the package. Referring now to FIG. 7, illustrated is a screenshot that permits a user to select optional services for the package in accordance with one embodiment of the present disclosure. As shown in the screenshot, the user may choose the optional services of certified mail by selecting box 710, proof of service by selecting box 720, or email confirmation by selecting box 730. The cost for the particular service is shown to the right of the screenshot. As the user selects optional services, the total price for the selected services may be previewed. The user may also preview the complete mailing package, if desired. Finally, the user may select the "deliver package" icon at 740 in order to direct that the package be delivered. The terms and conditions of service may be viewed by selecting the appropriate tab near the top of the screen.

Figure 8:
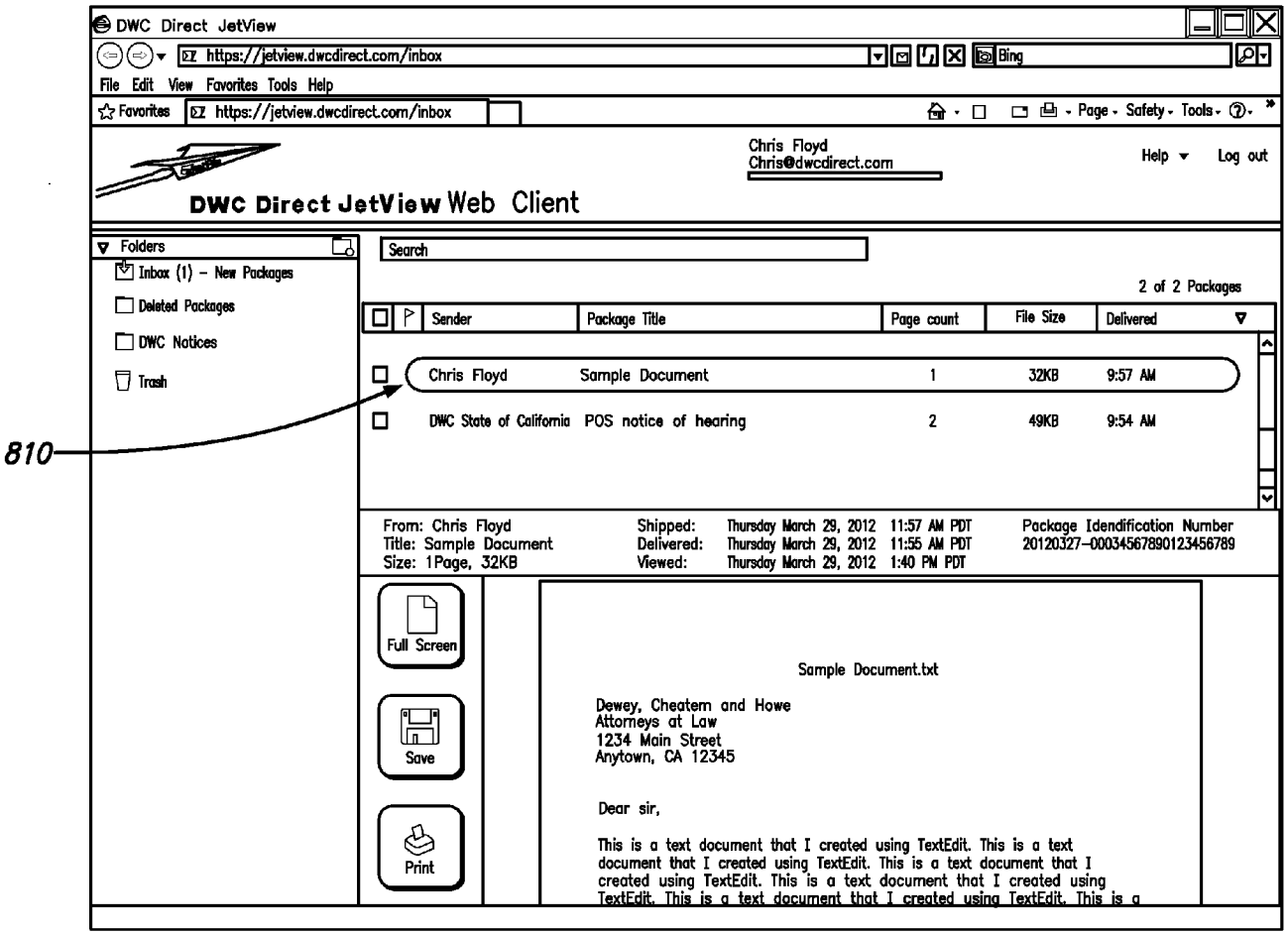
FIG. 8 is a screenshot at a recipient's computer after the recipient has opened the package subject to proof of service in accordance with one embodiment of the present disclosure.

After the package has been delivered to a user who has agreed to accept electronic documents, the package may be viewed by the appropriate recipient when he/she logs into his/her account. Referring now to FIG. 8, illustrated is a screenshot at a recipient's computer after the recipient has opened the package subject to proof of service in accordance with one embodiment of the present disclosure. Here, the recipient has received a package from Chris Floyd as shown at line 810. The recipient can see that the title is "Sample Document" as also shown at line 810. The recipient can also see the page count, file size and time the package was delivered.

The sender had selected the proof of service option when submitting the package to the system. Therefore, the system may generate a proof of service after the system determines the delivery method as physical or electronic. The sender may receive a copy of this proof of service after it has been generated by the system. Referring now to FIG. 9, illustrated is an example of a proof of service generated by the system. Here, the proof of service is signed by John Doe. It shows the subject documents to be delivered are a Notice and Request for Allowance of Lien, an Itemized Statement of Services and a 10770.5 Verification as shown under line 1010 which reads "Description of Documents Served". This proof of service shows the documents have been served on Insurance Company One and Insurance Company Two as shown at line 1020. The proof of service is signed by John Doe as shown at line 1015.

In addition to the proof of service, the sender may receive a receipt record showing that the document has been delivered to the recipient's account via the recipient's inbox, or that the document has been otherwise posted to the system for viewing by the intended recipient.

Referring now to FIG. 9, illustrated is a screenshot of a sender's receipt record for the package subject to proof of service in accordance with one embodiment of the present disclosure. This proof of service shows the unique package identification number at line 910 and that the package delivery is complete at line 920. The package title is also shown as "Sample Document" at line 930. The delivery charge is shown on the receipt at line 940. Also shown are the recipient at line and his address at line 950 and therebelow. Here, the recipient is Chris Floyd at DWC Direct whose address is 321 N. First St., Anytown, USA 12345. The delivery or audit log is shown at line 960 and below. It indicates the time that the package was accepted by the system for delivery. If the system is to carry out an electronic delivery the time stamps on the audit log showing electronic delivery and delivery completion may be very close to each other, e.g., within a second or two. In this example, delivery is carried out to a single electronic endpoint. However, if there were multiple endpoints in this example, and some were paper mail (not e-delivery), then the log may show different times for the e-delivery and the paper mail delivery times. The time differences could be in hours between the paper delivery end points and the e-delivery endpoints. In some cases, the time differences could be in days, since days might elapse between the time an electronic delivery occurs and a paper delivery occurs. For example, if a document was uploaded to the system on Friday, delivery to the paper endpoints might not begin until Monday, while the e-delivery endpoints would have received their documents on Friday.

The delivery log may show the date the system completed service of the subject document. In this example, the document in question was delivered electronically. Service may be considered complete when the document has been put into the recipient's electronic mailbox, or when the document has been otherwise posted to the system for viewing by the recipient. If the document is slated for physical delivery, service may be considered complete when the envelope has been deposited into a United States Postal Service mailbox or when the document was transferred or released to a carrier e.g., FEDERAL EXPRESS® or a personal courier.

Using the document delivery system of the present disclosure, a sender/shipper may receive a legal proof of service on paper and electronic documents delivered to all recipients. Moreover, the aggregation of physical documents permits the sender/shipper to send the documents at an efficient price point. Where the documents are delivered electronically, the shipper may be able to reduce costs even further since no carrier or paper shipping costs would be applicable.

While the specification describes particular embodiments of the present invention, those of ordinary skill can devise variations of the present invention without departing from the inventive concept.

What is claimed is:

1. A non-transitory computer-readable medium for document delivery with proof of service for physical and electronic documents, the computer readable medium embodying a set of instructions which, when executed by one or more computer processors, comprises:

a document receipt code segment configured to receive electronic documents for delivery to one or more physical and/or electronic endpoints, the document receipt code segment being further configured to receive a request for proof of service of each received electronic document to the one or more physical and/or electronic endpoints;

a mail delivery code segment configured to determine whether a received electronic document is to be delivered to a recipient via physical or electronic endpoint based on recipient data, wherein the mail delivery code segment is further configured to deliver the received electronic document to an electronic endpoint, if the determined endpoint is electronic;

a formatting code segment configured to format each received physical endpoint according to a formatting standard that permits aggregation of received electronic documents from multiple senders to a physical endpoint composed of known address components that substantially match address components for more than one received physical endpoint;

an aggregation code segment configured to facilitate the aggregation of physical documents into a single multi-document package from the multiple senders for delivery to the one or more endpoints, if the determined endpoint is physical;

a proof of service code segment configured to provide proof of service of each served physical and/or electronic document if a proof of service request has been received; and a receipt record code segment configured to generate and deliver a receipt record to a shipper, wherein the receipt record includes delivery data for the physical and/or electronic document, including the time a physical document was released to a carrier for physical delivery and/or the time an electronic document was delivered to an electronic endpoint; and a validation code segment configured to validate, based on either a unique identification code for each received electronic document or a unique package identification number for the single multi-document package, that the multi-document package addressed to the physical endpoint includes all received electronic documents for a recipient at the physical endpoint.

2. The computer-readable medium of claim 1, further comprising:

A physical mail release code segment configured to release each physical document to the carrier so that the physical document can be delivered to the one or more physical endpoints.

3. The computer-readable medium of claim 1, wherein the aggregation code segment is further configured, based on unbundled delivery requirements associated with a particular endpoint of the one or more physical endpoints, not to aggregate physical documents for delivery in a package to the particular endpoint.

4. The computer-readable medium of claim 1, wherein the proof of service for a physical document is included with the served physical document.

5. The computer-readable medium of claim 1, wherein the proof of service for a served electronic document includes receipt records accessible from the sender's account, wherein the receipt records include delivery data for the document, including the time the served electronic document was delivered to the electronic account for the recipient; and wherein the proof of service for a served physical document includes the date the physical document was released to the carrier.

6. The computer-readable medium of claim 1, further comprising:

an electronic tracking code segment configured to track electronic actions associated with a delivered electronic document, including printing and forwarding of the delivered electronic document.

7. The computer-readable medium of claim 1, wherein the set of instructions further comprises:

an email confirmation code segment configured to provide confirmation of delivery of electronic documents to the electronic endpoint or release of physical documents to the carrier.

8. The computer-readable medium of claim 1, wherein the set of instructions further comprises:

a certified mail code segment configured to certify that an electronic document was opened by the recipient and/or that a physical document was delivered by the carrier to the physical endpoint.

9. The computer-readable medium of claim 1, wherein the set of instructions further comprises:

a change of delivery method code segment configured to receive a request to change the delivery method from electronic to physical, when the document is delivered to an electronic endpoint but remains unopened for a predetermined period of time, wherein in response to a request to change the delivery method from electronic to physical, the change of delivery method code segment is further configured to recall the unopened document from the electronic delivery endpoint and re-send the document by physical delivery.

10. The computer-readable medium of claim 1, wherein the set of instructions further comprises:

a unique identification code generator code segment configured to generate a the unique identification code for each electronic document received for delivery to the one or more physical and/or electronic endpoints.

11. The computer-readable medium of claim 1, wherein the proof of service is configured according to a specific legal standard, defined by local, state or federal law, and said proof of service is capable of being used in a court of law as proof that the received electronic document was served on a recipient identified in the proof of service.

12. The computer-readable medium of claim 1, wherein the document receipt code segment is further configured to receive searchable terms associated with the received electronic document, and the set of instructions further comprises:

a searchable term code segment configured to retrieve, based on received searchable terms, all received electronic documents associated with the searchable terms, including received electronic documents for delivery to one or more physical endpoints.

13. A computer-based method for delivering physical and electronic documents with proof of service, comprising the steps of:

receiving, by a computer, a plurality of electronic documents for delivery to one or more physical and/or electronic endpoints, wherein at least one of the plurality of received electronic documents includes recipient data indicating a delivery to a physical endpoint, and at least one of the plurality of electronic documents includes recipient data indicating a delivery to an electronic endpoint;

storing, by the computer, the plurality of received electronic documents;

generating, by the computer, a unique identification code for each electronic document received for delivery to the one or more physical and/or electronic endpoints determining, by the computer, whether a received electronic document is to be delivered to a recipient via physical or electronic endpoint based on recipient data; and in response to the determining step, performing the following steps for each of the plurality of electronic documents:

if the determining step indicates a delivery to a physical endpoint, formatting, by the computer, each received physical endpoint according to a formatting standard that permits aggregation of received electronic documents from multiple senders to a physical endpoint composed of known address components that substantially match address components for more than one received physical endpoint;

if the determining step indicates a delivery to a physical endpoint, facilitating, by the computer, aggregation of physical documents into a single multi-document package for delivery to the one or more physical endpoints or, based on unbundled delivery requirements associated with a particular endpoint of the one or more endpoints, determining, by the computer, that aggregation will not occur for physical documents to the particular endpoint;

if the determining step indicates a delivery to an electronic endpoint, delivering, by the computer, the received electronic documents to electronic endpoints;

if a request for proof of service has been received, providing, by the computer, proof of service of each served physical and/or electronic document; and generating, by the computer, and delivering, by the computer, an electronic receipt record to a shipper, wherein the receipt record includes delivery data for the served physical and/or electronic document, including the time the electronic document was delivered to the electronic endpoint and/or the time the physical document was released to a carrier for physical delivery; and validating, by the computer, based on either a unique identification code for each received electronic document or a unique package identification number for the single multi-document package, that the multi-document package addressed to the physical endpoint includes all received electronic documents for a recipient at the physical endpoint.

14. The method of claim 13, further comprising the step of:

releasing one or more physical documents to the carrier so that the physical documents can be delivered to the one or more physical endpoints.

15. The method of claim 13, wherein the proof of service for a physical document is included with the served physical documents.

16. The method of claim 13, wherein the proof of service for an electronic document includes receipt records accessible from the sender's account, wherein the receipt records include delivery data for the document, including the time the served electronic document was delivered to the electronic account for the recipient, and/or the date the physical document was released to the carrier.

17. The method of claim 13, further comprising:

tracking, by the computer, electronic actions associated with a delivered electronic document, including printing and forwarding of the delivered electronic document.

18. The method of claim 13, further comprising:

receiving, by the computer, a request for email delivery confirmation from the sender; and providing, by the computer, email confirmation of delivery to the physical or electronic endpoint.

19. The method of claim 13, further comprising:

receiving, by the computer, a request for certified mail from the sender;

receiving, by the computer, certification that the recipient has opened the delivered electronic document and/or that the carrier has delivered the physical document to the recipient.

20. The method of claim 13, further comprising:

when the served electronic document is delivered to an electronic endpoint but remains unopened for a predetermined period of time, receiving, by the computer, a request to change the delivery endpoint from electronic to physical; and recalling, by the computer, the unopened served electronic document from the electronic delivery endpoint and resending the served electronic document by physical delivery to a physical endpoint.

21. The method of claim 13, wherein the proof of service is configured according to a specific legal standard, defined by local, state or federal law, and said proof of service is capable of being used in a court of law as proof that the received electronic document was served on a recipient identified in the proof of service.

22. The method of claim 13, wherein the receiving step includes receiving searchable terms associated with the plurality of received electronic documents, and the method further comprises:

retrieving, based on received searchable terms, all received electronic documents associated with the searchable terms, including received electronic documents for delivery to one or more physical endpoints.

* * * * *